US006932329B1

(12) United States Patent
Harder

(10) Patent No.: US 6,932,329 B1
(45) Date of Patent: Aug. 23, 2005

(54) RAILING

(76) Inventor: Willard J. Harder, 20355 Eaves Way, Farmington, MN (US) 55024

( * ) Notice: Subject to any disclaimer, the term of this patent is extended or adjusted under 35 U.S.C. 154(b) by 22 days.

(21) Appl. No.: 10/636,034

(22) Filed: Aug. 8, 2003

Related U.S. Application Data

(60) Provisional application No. 60/418,280, filed on Oct. 15, 2002.

(51) Int. Cl.[7] ..... E04H 17/14
(52) U.S. Cl. ..... 256/67; 25/19; 25/22; 25/65.01
(58) Field of Search ..... 256/1, 19, 22, 256/65.01, 67, 70; 403/56, 76, 90, 114, 115, 403/122–144

(56) References Cited

U.S. PATENT DOCUMENTS

| | | | | |
|---|---|---|---|---|
| 1,772,159 | A * | 8/1930 | Roth | 256/67 |
| 4,150,907 | A | 4/1979 | Thurnauer | |
| 4,505,456 | A | 3/1985 | Zieg | |
| 4,645,598 | A * | 2/1987 | Hannum | |
| 4,928,930 | A | 5/1990 | Chung | |
| 5,169,210 | A * | 12/1992 | Fricano | |
| 5,288,058 | A | 2/1994 | Russell | |
| 5,404,682 | A | 4/1995 | West | |
| 5,641,236 | A | 6/1997 | Hornung et al. | |
| 6,568,658 | B2 | 5/2003 | Strome | |
| 2002/0134977 | A1 | 9/2002 | Bryan | |

OTHER PUBLICATIONS

Boac International, Inc Evaluation Report.

* cited by examiner

*Primary Examiner*—Daniel P. Stodola
*Assistant Examiner*—Victor MacArthur

(57) ABSTRACT

A deck and stair railing has top and bottom rails joined to upright posts and upright tubes extended between the rails. Ball knobs mounted on plates or the rails are secured with deck screws to the rails to retain the tubes in assembled relation with the rails. The ball knobs have circumferential ribs located in force fit relation with inside surfaces of the tubes. The tubes have projections that engage the ball connectors to prevent the tubes from rotating relative to the ball connectors.

14 Claims, 9 Drawing Sheets

RAILING

RELATED APPLICATION

Applicant claims the priority date of U.S. Provisional Patent Application Ser. No. 60/418,280 filed Oct. 15, 2002.

FIELD ON THE INVENTION

The invention is the art of railings, fences and barriers used to separate environmental areas. The particular field of the invention relates to residential and commercial railings having upright laterally spaced balusters or spindles attached to rails.

BACKGROUND OF THE INVENTION

Residential decks and stairs have railings to separate these structures from adjacent areas and prevent persons from falling off the decks and stairs. The railings have top rails support on upright posts attached to the decks and stairs. A number of laterally spaced upright members, known as balusters, spindles or pickets, extend between the top rails and decks and stairs. Wood upright members are fastened to the rails with nails, screws and adhesives. Dowel-type joints are also used to connect opposite ends of wood upright members to top and bottom rails. Metal railings have upper and lower rails and upright metal members extended between and welded to the rails. Fasteners, such as screws, are used to connect top and bottom metal rails to opposite ends of the upright metal members. Railings for stairs have upright members with at least one angled end or angled opposite ends. Each angled end must be secured to an inclined stair railing. A substantial amount of time, labor and craftsmanship is employed to assemble and construct deck and stair railings.

Wood rails for decks and stairs are treated with chemical preservatives containing copper containing materials to inhibit wood decay. Holes in the top and bottom rails accommodating opposite ends of aluminum or aluminum alloy spindles attach the spindles to the rails. Over time, copper corrodes aluminum causing the spindles break away from the rails. Inserts are used to insulate the ends of the spindles from the treated wood rails to inhibit corrosion of aluminum spindles.

Examples of railing and baluster structures are disclosed in the following U.S. patents.

S. A. Zieg in U.S. Pat. No. 4,505,456 discloses upright balusters extended between inclined top and bottom rails. Pivots on opposite ends of the balusters fit in sockets in the rails to connect the balusters to the rails. The pivots have parallel opposite sides and convex shaped opposite ends that allow angular movement of the balusters in only one vertical plane.

Y. K. Chung in U.S. Pat. No. 4,928,930 discloses a railing having top and bottom rails having rectangular grooves accommodating U-shaped plug members. Balusters have rounded opposite ends that fit in the U-shaped plug members. Fasteners, such as bolts, extended through slots in the plug members, secure the plug members to the opposite ends of the balusters. The angle between the top rail and each of the balusters is adjusted to move the top rail relative to the bottom rail to locate the top and bottom rails to be substantially parallel with a staircase to which the railing is mounted.

G. F. Strome in U.S. Pat. No. 6,568,658 discloses a railing having cylindrical shank connectors secured to rails or supports for connecting opposite ends of tubular members to rails. The connectors have circumferential external grooves accommodating O-rings. The tubular members telescope over the connectors and compress the O-rings to lock the tubular members on the connectors. The shank connectors do not allow angular adjustment of the tubular members relative to a rail.

E. J. A. Gierzak in U.S. Patent Application Publication U.S. 2002/0134977 discloses a hand rail assembly having upper and lower channel members extended between upright posts. Connectors secured to the channel members accommodate opposite ends of upright square tubular spindle members. The connectors are square bosses with a series of ribs on the outer walls for a friction fit with the spindle members and to prevent rotation of the spindle members on the connectors. The connectors do not permit angular adjustment of the spindle members relative to the rail.

SUMMARY OF THE INVENTION

The invention comprises a railing for a deck and stair having top and bottom rails connected to upright posts anchored to supports. Upright spindle members extended between the top and bottom rails have opposite ends located in surface contact with flat members positioned on the rails. Ball knobs or ball connectors engage the flat members. Fasteners, such as deck screws, secure the knobs to the rails and maintain the knobs in firm engagement with the flat members. The spindle members are cylindrical metal tubes, such as coated aluminum tubes. The spindle members can be square or multi-sided metal or plastic tubes. The opposite ends of the spindle members are telescoped over the knobs to anchor and retain the spindle members in fixed upright positions between the top and bottom rails. The ball knobs have hemispherical configurations with a size to accommodate the inside walls of the spindle members with a tight friction or force fit. The opposite ends of the spindle members have end surfaces located in surface engagement with the flat members which space the tubes from the rails. The tight friction fit relation between the ball knobs and inside walls of the spindle members provide seals to prevent moisture, water, dust, and first from entering the spaces with the spindle members. The ball knobs have a plurality of outwardly directed annular ribs which flex inwardly when the spindle members are mounted on the ball knobs. The ribs are located in planes normal to the axis of the hole through the body of the ball knob. The ribs are separate sealing rings located in a force fit biased relation with the inside walls of the spindle members. Ball knobs in an alternate embodiment have continuous external convex surfaces that are in a tight friction or compression fit with the inside walls of the spindle members. The ball knobs allow the spindle members to be moved to inclined positions relative to the rails without modifications or additional structures or welds. the knobs are ball connectors which can be secured directly to the top and bottom rails. The spindle members mounted on the ball knobs extend between and engage the top and bottom rails. An alternate embodiment of the spindle member comprises an elongated metal or plastic tube having an inside cylindrical wall with inwardly directed longitudinal projections or ribs. The projections are forced into the sides of the ball knobs when the spindle members are pressed onto the ball knobs. The projections prevent the spindle members from rotating relative to the ball knobs. The ball knobs are installed on the rails with a minimum of time and labor and with conventional tools. The ends of the spindles cover the ball knobs rendering the railing aesthetically pleasing and decorative.

DESCRIPTION OF EMBODIMENTS OF THE INVENTION

Figure 1:
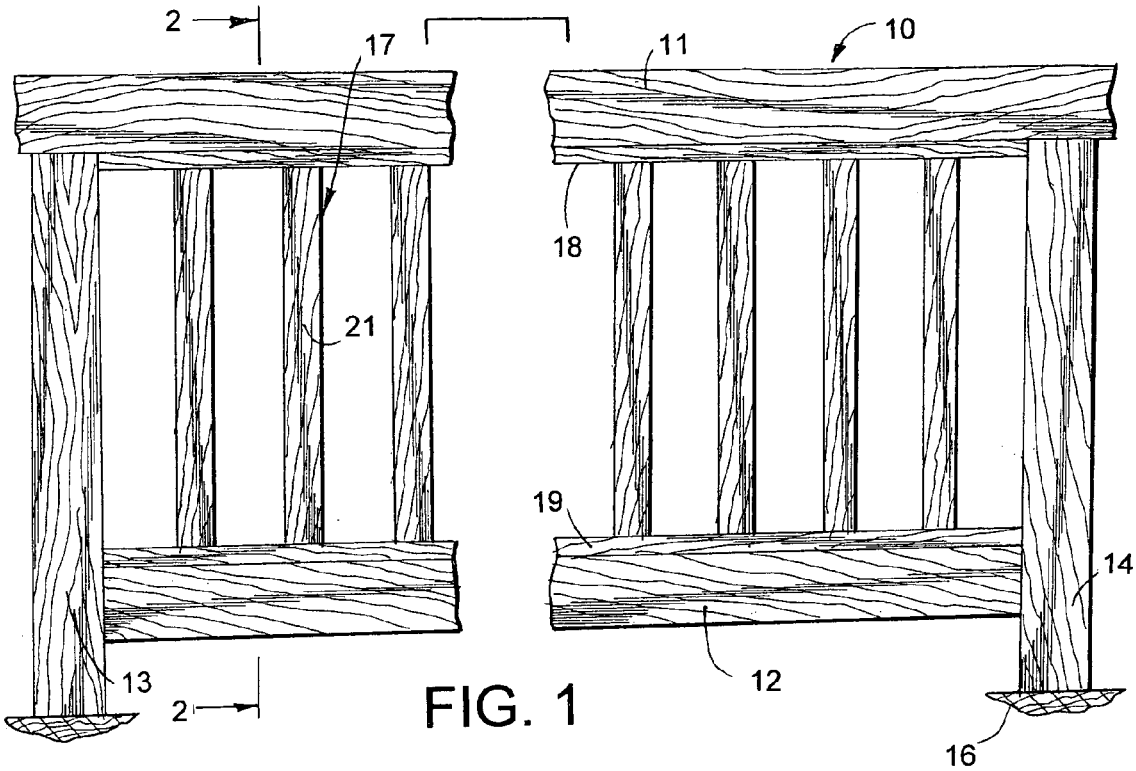
FIG. 1 is a foreshortened side elevational view of a section of a railing of the invention.

A railing 10, shown in FIG. 1, has horizontal top and bottom rails 11 and 12 joined to upright columns or posts 13 and 14 providing a generally rectangular opening for a plurality of laterally spaced spindles or balusters 17. Posts 13 and 14 are anchored to a support 16, such as a floor, deck, or ground. Rails 11 and 12 and posts 13 and 14 are conventional wood members. Plastic, metal and composite materials can be used for the rails and posts. The spindles 17 comprise laterally spaced upright cylindrical tubes or linear tubular members 21. Tubular members 21 are metal tubes, such as aluminum tubes. Other materials, such as plastic or composite materials, can be used for spindles 17. A plurality of laterally spaced upright linear tubes 21 are located between rails 11 and 12. The opposite ends of the tubes 21 are retained with ball connectors or ball knobs 23 in surface engagement with flat plates 18 and 19 located in surface engagement with top and bottom rails 11 and 12 to space the ends of tubes 21 from rails 11 and 12. Each of plates 18 and 19 has a row of laterally spaced holes 20 and 25 that register the lateral space between tubes 21. Washers or spacers can be used in lieu of plates 18 and 19 to space the ends of tubes 21 from rails 11 and 12, as shown in FIGS. 24 to 28. An alternative railing has the opposite ends of the tubes in direct contact with the top and bottom rails or bottom support, as shown in FIG. 29.

Figure 2:
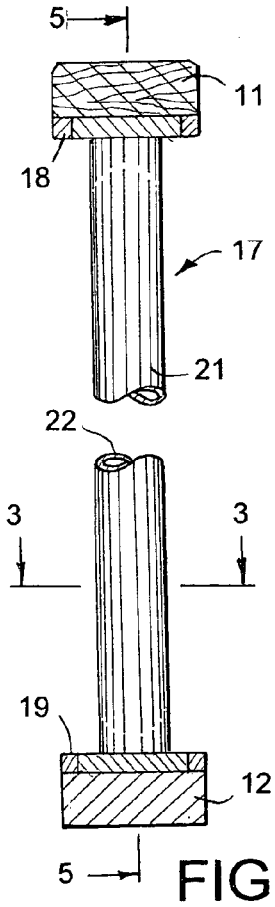
FIG. 2 is an enlarged foreshortened sectional view taken along line 2—2 of FIG. 1.
Figure 3:
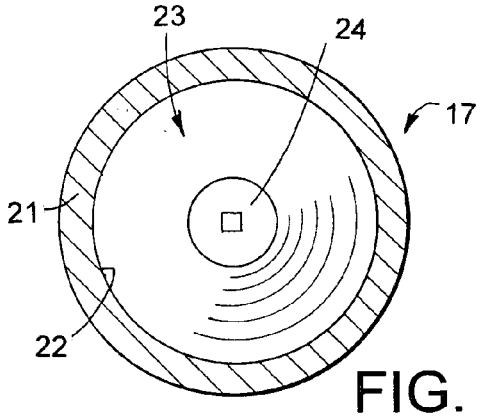
FIG. 3 is an enlarged sectional view taken along line 3—3 of FIG. 2.

The following description is directed to tube 21. As shown in FIGS. 2 and 3, tube 21 has an inside cylindrical wall 22 having a uniform diameter at its opposite ends. The upper end of tube 21 is flush against a top plate 18 located below rail 11 and extended between posts 13 and 14. The lower end of tube 21 is flush against a bottom plate 19 located on top of bottom rail 12. The end surfaces of tube 21 are transverse and perpendicular to the longitudinal axis of the tube. The outside surfaces of plates 18 and 19 are flat so that the end surfaces of tube 21 are in surface contact with the flat surfaces of plates 18 and 19. The surface engagement of the ends of tube 21 inhibit moisture, water, dust and dirt from entering tube 21 and collecting between the ends of the tube 21 and plates 18 and 19. The opposite ends of tube 21 can be located in direct surface contact with the top and bottom rails, as shown in FIG. 29.

Figure 5:
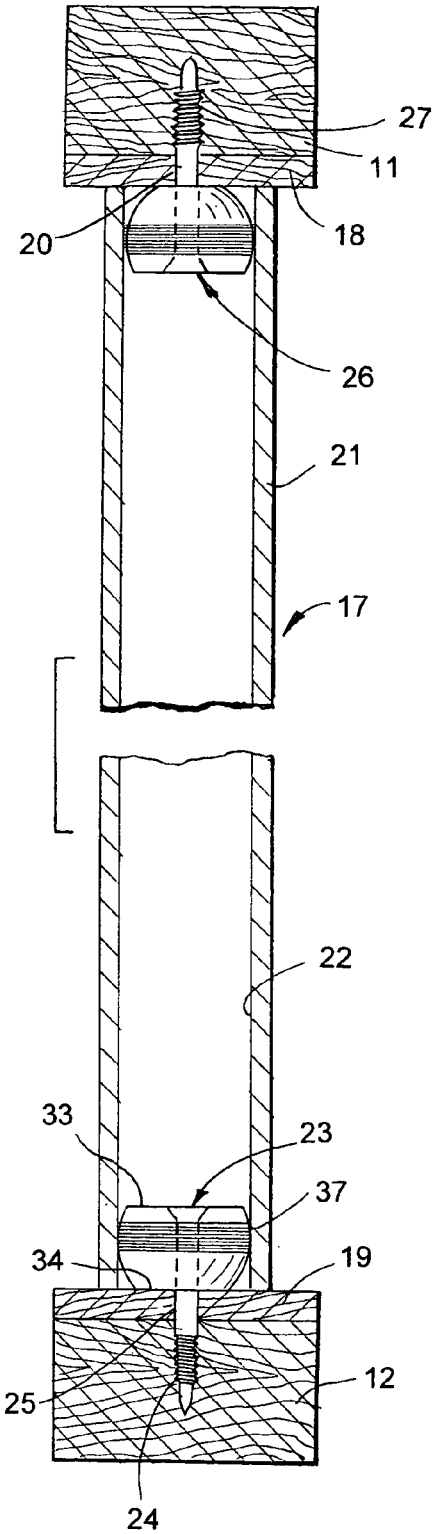
FIG. 5 is an enlarged foreshortened sectional view taken along line 5—5 of FIG. 2.

As shown in FIG. 5, the lower end of tube 21 telescopes over a ball knob or ball connector indicated generally at 23. A fastener shown as a deck screw 24, secures ball knob 23 to plate 19 and rail 12. Screw 24 also holds plate 19 firmly in engagement with the top of rail 12. The upper end of tube 21 telescopes over a ball knob 26 secured to plate 18 and rail 11 with a fastener, shown as a deck screw 27. Knobs 23 and 26 can be secured with deck screws directly to rails 11 and 12. The inside surfaces of the upper and lower ends of tube 21 have a tight friction or force fit around ball knobs 23 and 26 thereby anchoring tube 21 to rails 11 and 12.

Figure 4:
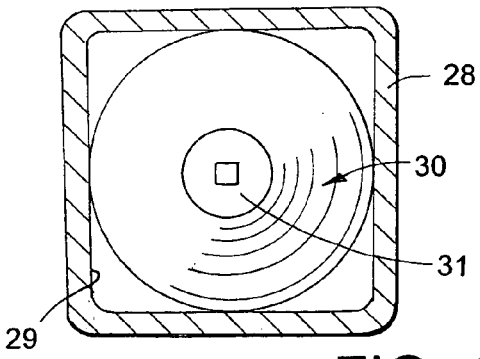
FIG. 4 is a sectional view similar to FIG. 3 showing a modification of the cross section of an upright spindle member of the railing.

A modification of the cross section of the upright spindles of the railing is shown in FIG. 4. Spindle 28 has a generally square cross section with a square inside wall 29. A ball knob 30 accommodating a fastener such as screw 31 secures ball knob 30 to a plate and rail. Ball knob 30 has the same structure and function as knobs 23 and 26. Opposite portions of inside wall 29 are located in a tight frictional fit with ball knob 30 to maintain bar 28 in assembled relation with ball knob 30 and anchor spindle 28 on rails 11 and 12.

Figure 6:
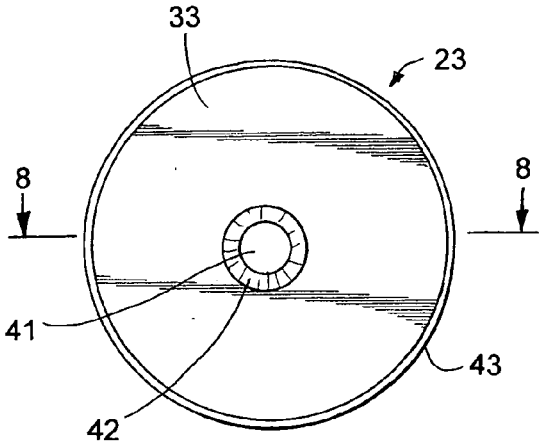
FIG. 6 is a top plan view of the ball knob shown in FIG. 5.
Figure 7:
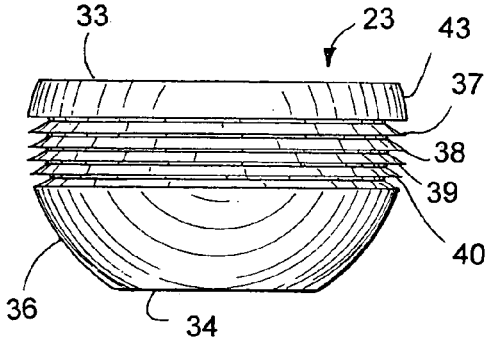
FIG. 7 is a side elevational view of the ball knob of FIG. 6.
Figure 8:
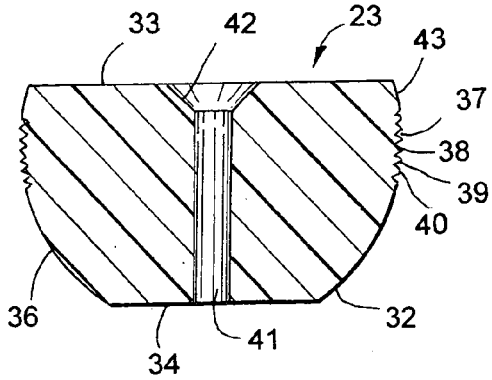
FIG. 8 is a sectional view taken along line 8—8 of FIG. 6.
Figure 9:
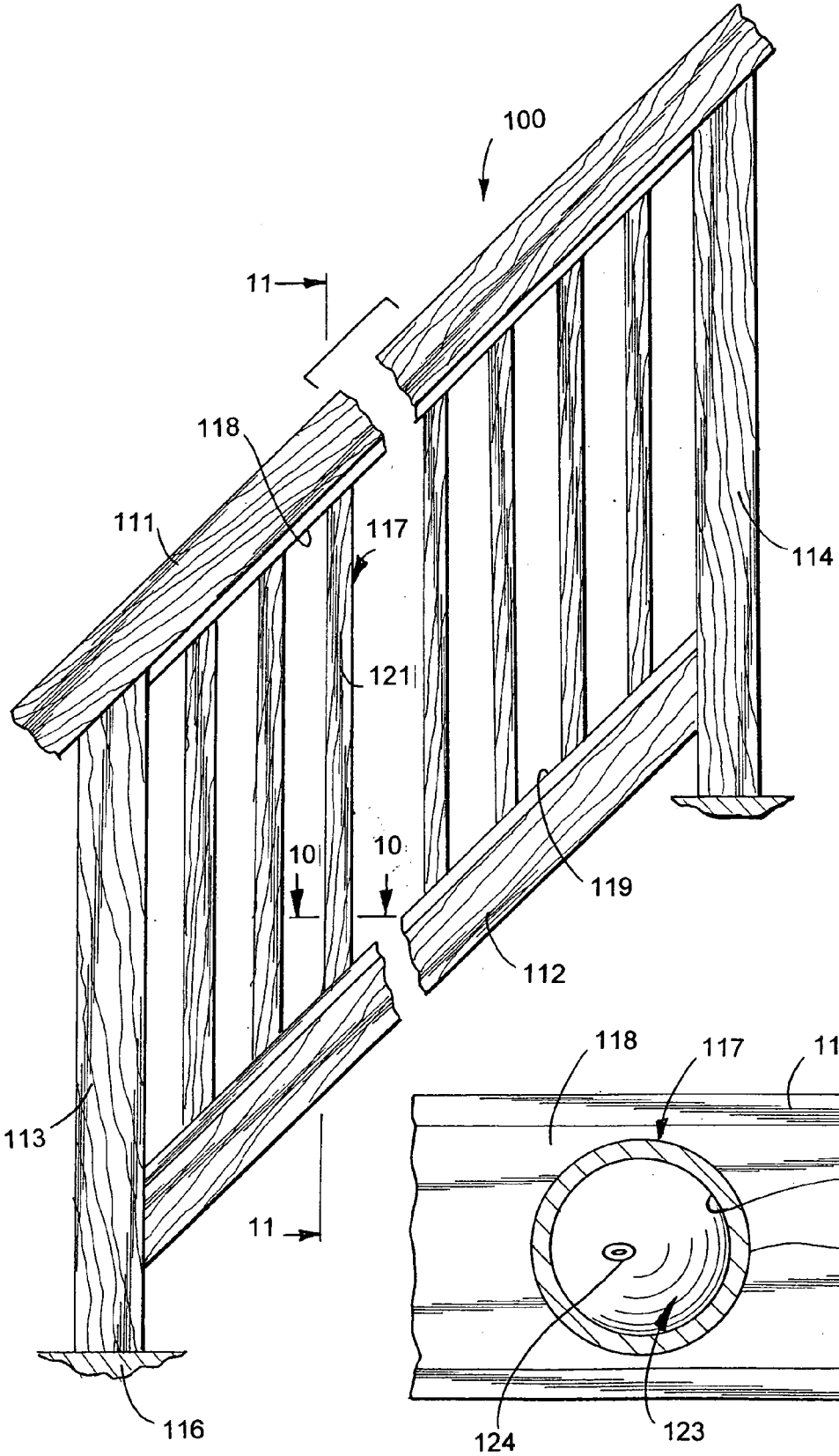
FIG. 9 is a foreshortened side elevational view of a modification of the railing of FIG. 1.
Figure 10:
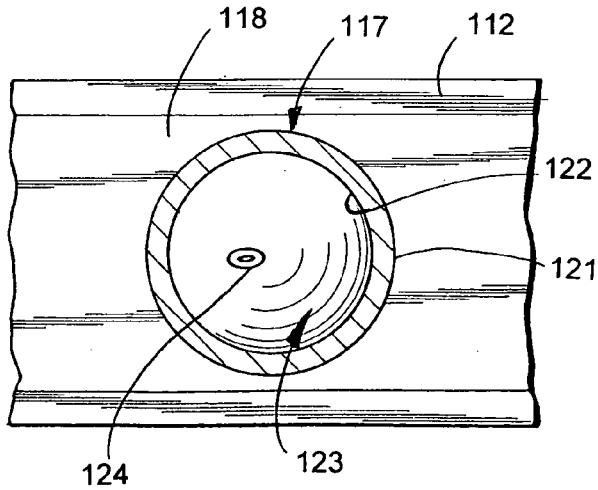
FIG. 10 is an enlarged sectional view taken along line 10—10 of FIG. 9.
Figure 11:
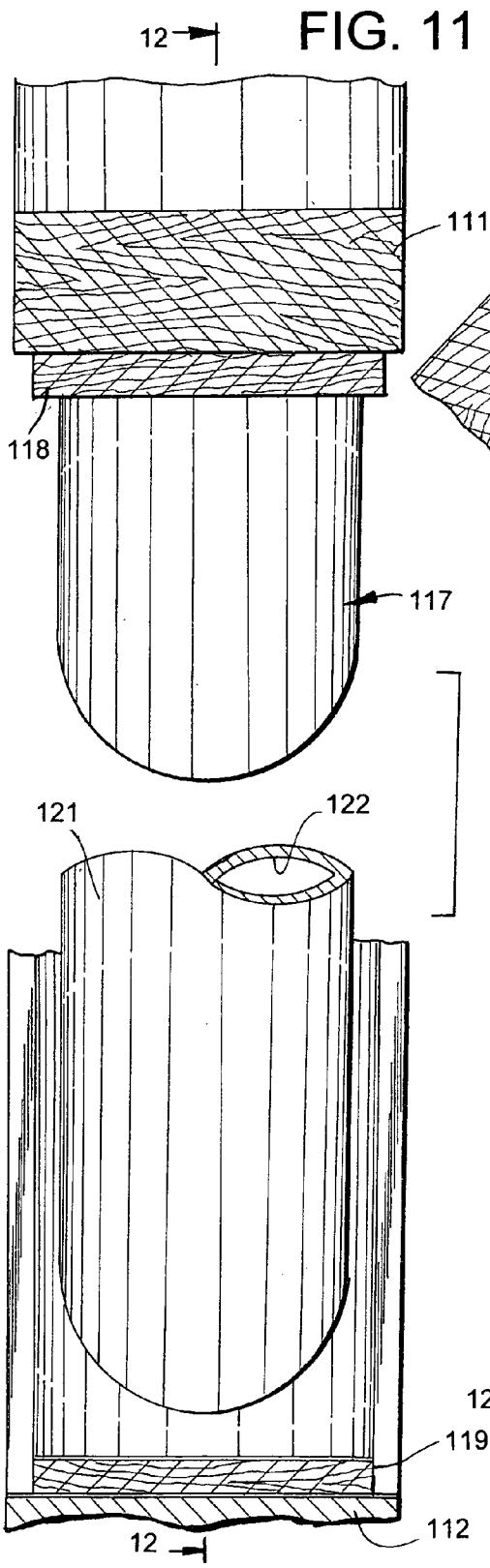
FIG. 11 is an enlarged foreshortened sectional view taken along line 11—11 of FIG. 9.

The details of ball connector or ball knob 23 is shown in FIGS. 6 to 8. Knob 23 has a truncated spherical body 32 with a flat top circular surface 33 and a flat bottom circular surface 34. Body 32 is a one-piece rigid plastic member, such as high density polyethylene or Delrin. Body 32 can be a metal one-piece member. An annular convex curved side wall 36 extends between top and bottom surfaces 33 and 34. Side wall 36 is a segment of a sphere. A plurality of spaced circumferential outwardly extended continuous ribs 37, 38, 39 and 40 extend around the mid-section of side wall 36. The number and size of the ribs can vary. A cylindrical hole or passage 41 extended through the center of body 32 is open to surfaces 33 and 34. Hole 41 has a size to accommodate the shank of a deck screw 24 with a close contact fit. The outer end of hole 41 has a cone-shaped recess 42 for the head of screw 24. Alternative fasteners can be used to secure knob to rail 12. Surfaces 33 and 34 and ribs 37–40 are located in planes normal to the axis of hole 41 in body 32. The outer annular section 43 of side wall 36 adjacent top surface 33 has a downwardly and outwardly curved annular tapered shape with a diameter slightly smaller than the diameter of the inside wall 22 of tube 21. The outer annular section 43 allows the end of tube 21 to be aligned with ball knob 23 and guides tube 21 into tight telescopic relation with ribs 37–40. Ribs 37–40 have outer diameters greater than the diameter of inside wall 22 of tube 21. Tube 21 when located on knob 23 deform ribs 37–40 providing annular elastic seals compressed against inside wall 22 of tube 21. These annular seals prevent moisture, water, dust and dirt from entering the inside of tube 21. Knobs 26 and 30 have the same structure, size, shape, and material as ball knob 23. An alternative ball knob 223, as shown in FIGS. 13 to 16, has continuous convex side walls without ribs having a size to engage the inside wall 222 of tube 221 with a tight friction or force fit. The ball knobs can have a spherical shape with a hole for a fastener.

Figure 12:
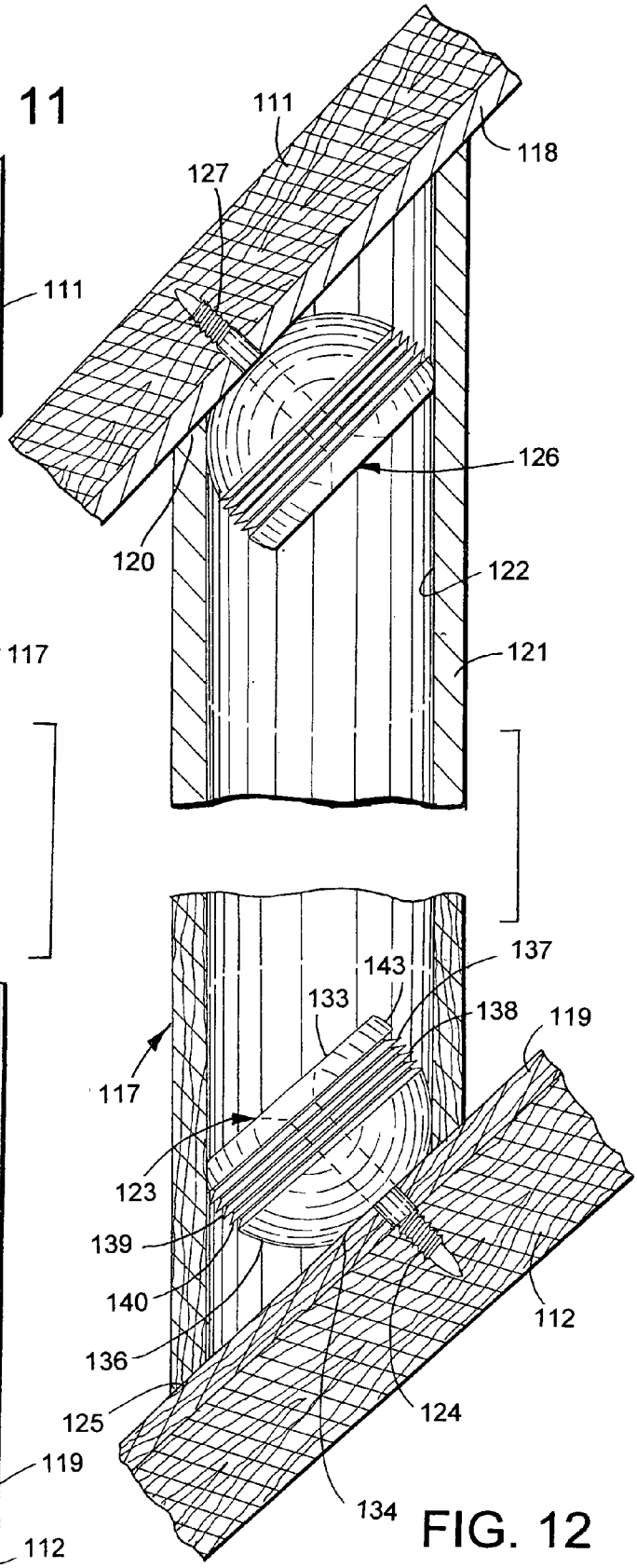
FIG. 12 is a foreshortened sectional view taken along line 12—12 of FIG. 11.
Figure 13:
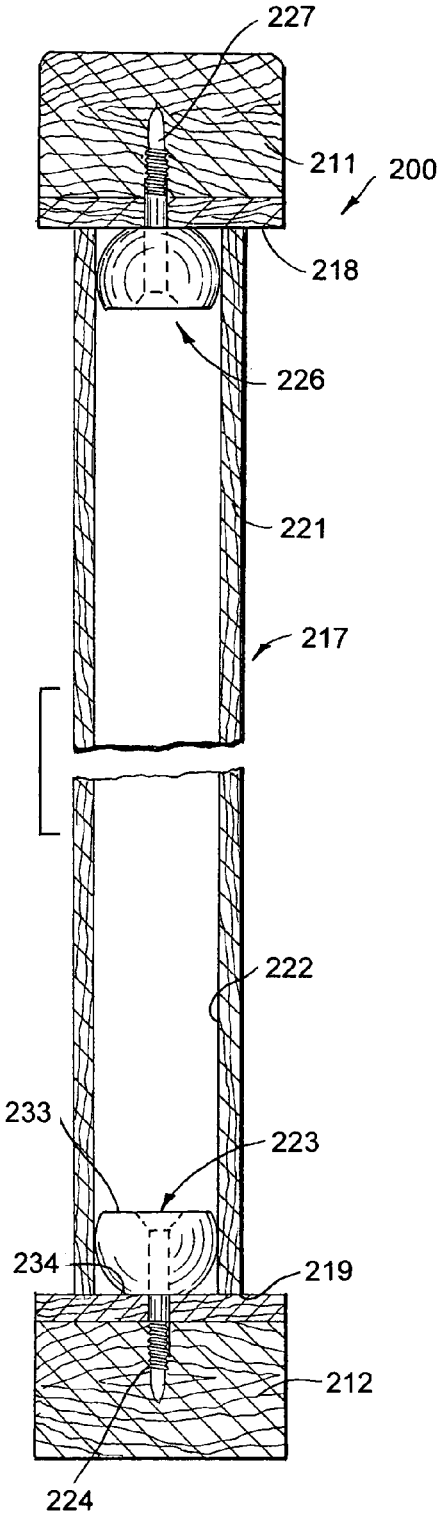
FIG. 13 is a foreshortened sectional view similar to FIG. 5 showing a modification of the ball knob.
Figure 14:
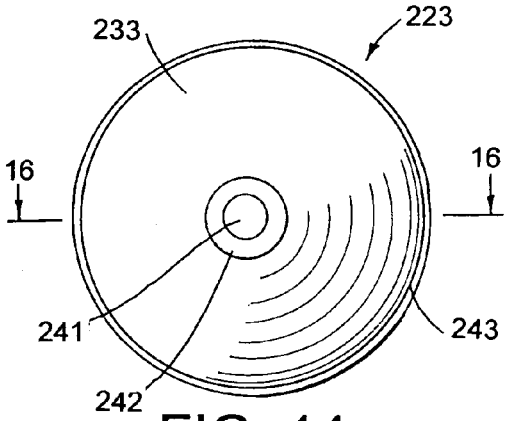
FIG. 14 is a top plan view of the ball knob of FIG. 13.
Figure 15:
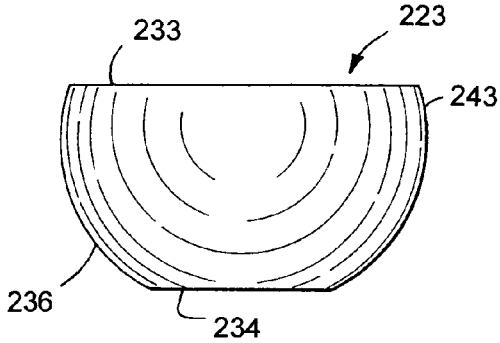
FIG. 15 is a side elevational view of the ball knob of FIG. 14.
Figure 16:
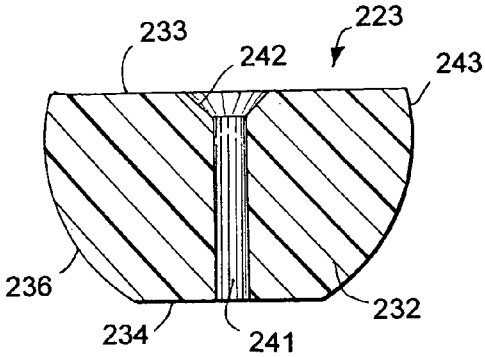
FIG. 16 is a sectional view taken along line 16—16 of FIG. 14.
Figure 17:
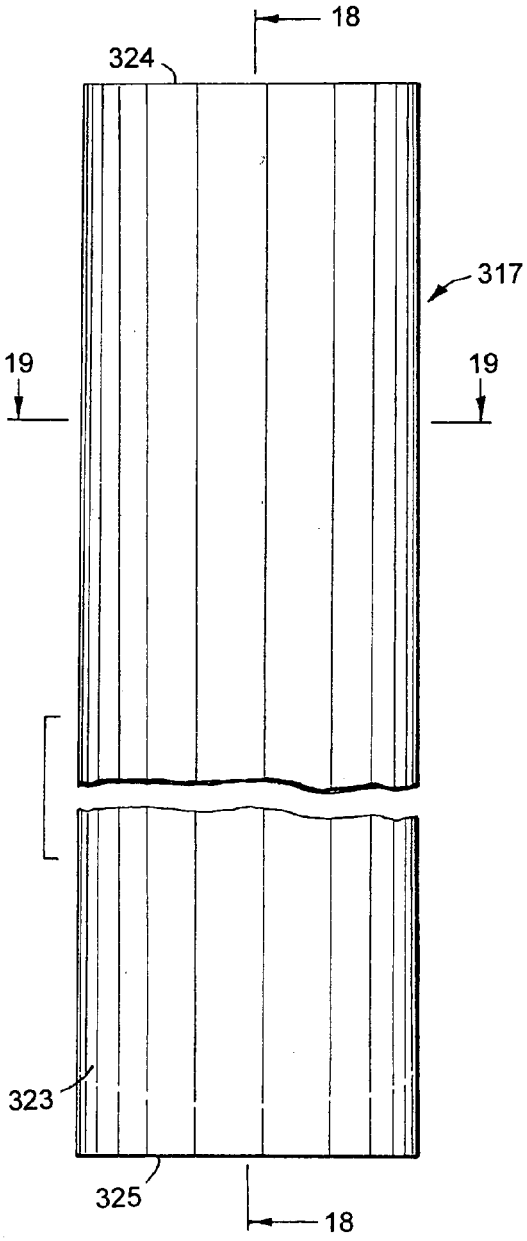
FIG. 17 is a foreshortened front elevational view of a modification of a spindle member for the railing.
Figure 18:
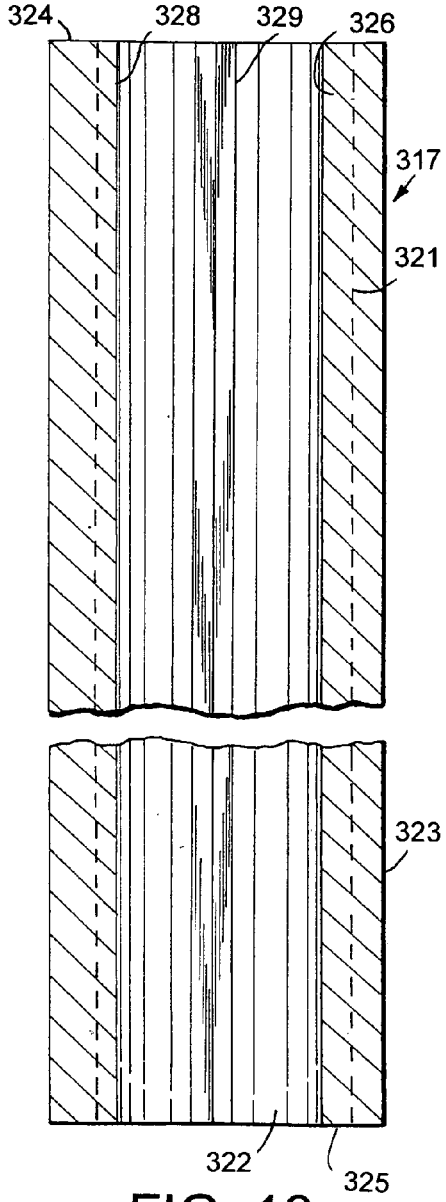
FIG. 18 is a foreshortened sectional view taken along line 18—18 of FIG. 17.

A first modification of the railing, shown in FIGS. 9 to 12, is indicated generally at 100. The parts of railing 100 that correspond to the parts of railing 10 have the same reference numbers with the prefix 1. Rails 111 and 112 are stair rails that extend in an upward angle direction that correspond to the angle of a stair case. Plates 118 and 119 are metal linear flat members located in surface engagement with rails 111 and 112. Spindles 117 are cylindrical tubes 121 extended between plates 118 and 119. Adjacent spindles are laterally spaced from each other along the length of rails 111 and 112. As shown in FIG. 12, the upper end of tube 121 has a diagonal end surface 120 located in surface contact with the flat surface of plate 118. The lower end of tube 121 has a diagonal end surface 125 located in surface contact with the adjacent flat surface of plate 119. Ball knob 123 secured to plate 119 and rail 112 with deck screw 124 is located in tight frictional engagement with the inside wall 122 of tube 121 to anchor tube 121 to rails 111 and 112. Opposite portions of annular section 143 and side wall 136 are in tight sealing engagement with transverse opposite portions of the inside wall 122 of tube 121. This tight engagement is maintained independently of the angle of tube 121 relative to plates 118 and 119. The upper end of tube 121 telescopes over knob 126 to position tube 121 on plate 118. Ball knob 126 has the same tight frictional fit with inside wall 122 as knob 123. Ball knobs 123 and 126 can be secured with deck screws directly to rails 111 and 112, as shown by ball knobs 23 and 26 in FIG. 29.

A second modification of the railing indicated generally at 200 is shown in FIGS. 13 to 16. The parts of railing 200 that correspond to the parts of railing 10 have the same reference number with the prefix 2. The ball knobs or ball connectors 223 and 226 have flat top and bottom surfaces 233 and 234 and a convex side wall 236 extended between surfaces 233 and 234. Side wall 236 is a segment of a sphere having a diameter slightly larger than the inside diameter of the inside surface 222 of tube 221 whereby the tube 221 when mounted on ball knobs 223 and 226 has a tight or force fit on ball knobs 223 and 226. The upper portion 243 of ball knob 223 curves outwardly or tapers to guide the end of tube 221 onto ball knob 223.

Figure 19:
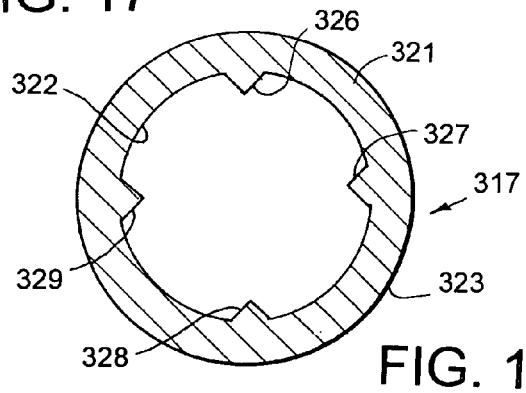
FIG. 19 is a sectional view taken along line 19—19 of FIG. 17.
Figure 20:
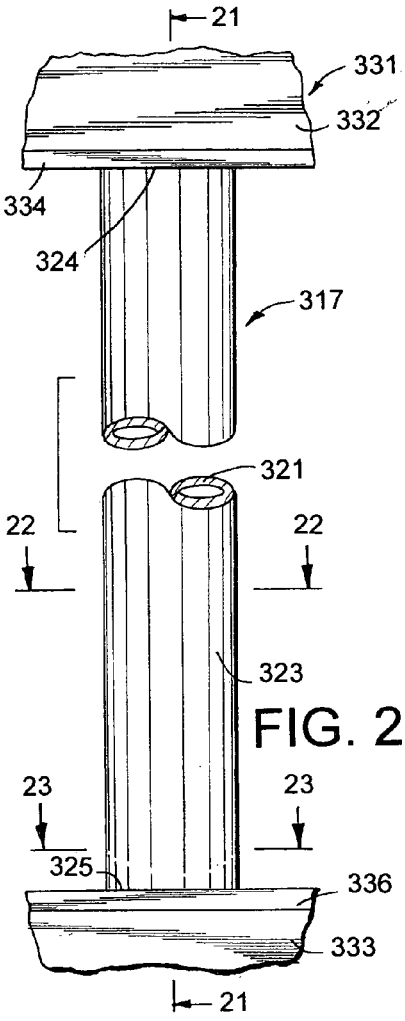
FIG. 20 is a foreshortened front elevational view of a section of a railing having the spindle of FIG. 17.
Figure 21:
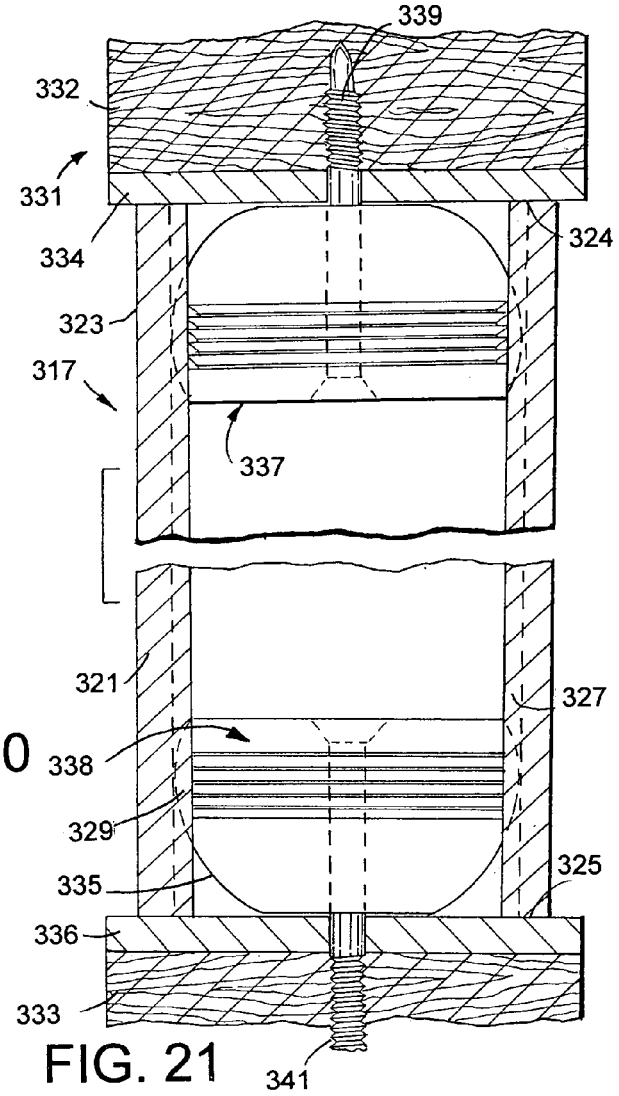
FIG. 21 is a foreshortened enlarged sectional view taken along the line 21—21 of FIG. 20.
Figure 22:
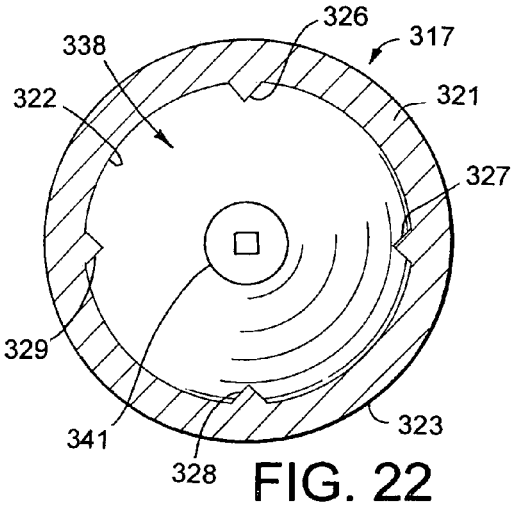
FIG. 22 is an enlarged sectional view taken along line 22—22 of FIG. 20.
Figure 23:
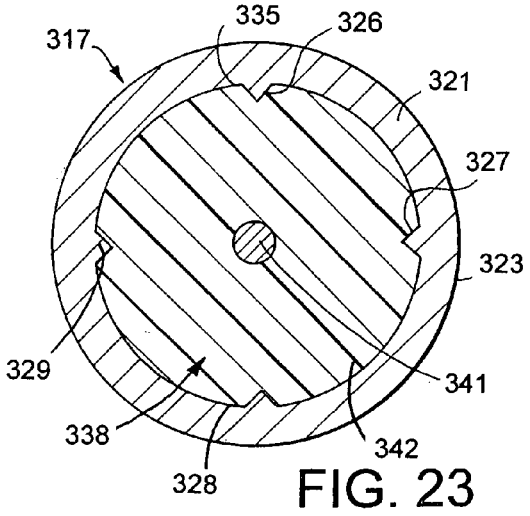
FIG. 23 is an enlarged sectional view taken along line 23—23 of FIG. 20.
Figure 24:
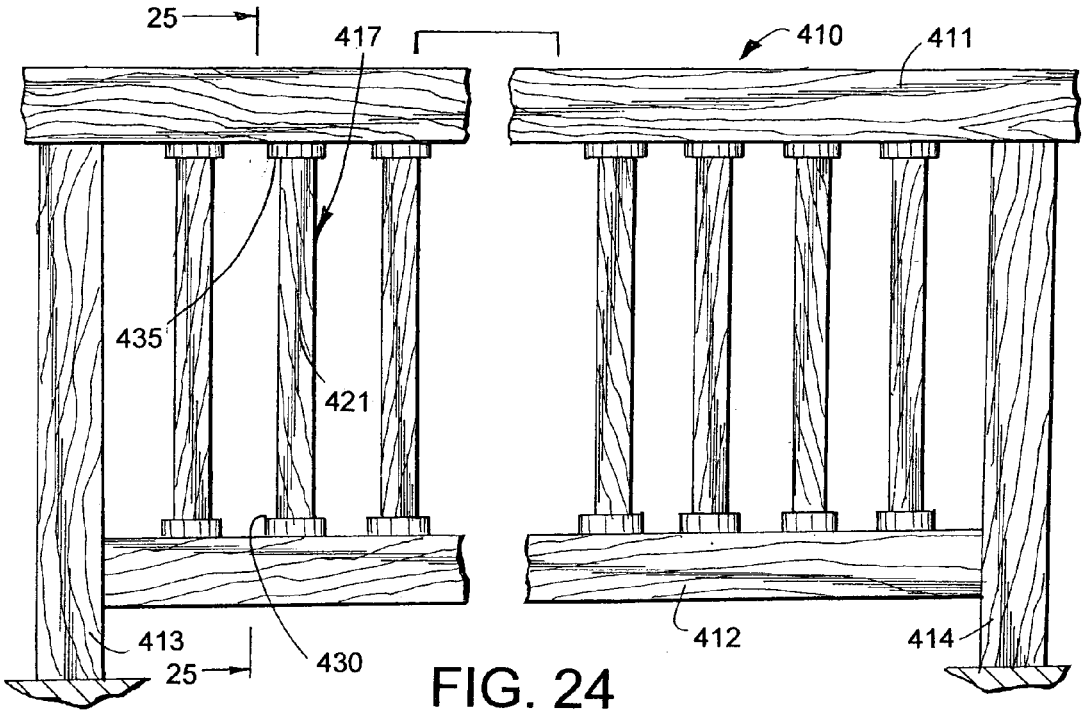
FIG. 24 is a foreshortened side elevational view of another modification of the railing of FIG. 1.
Figure 25:
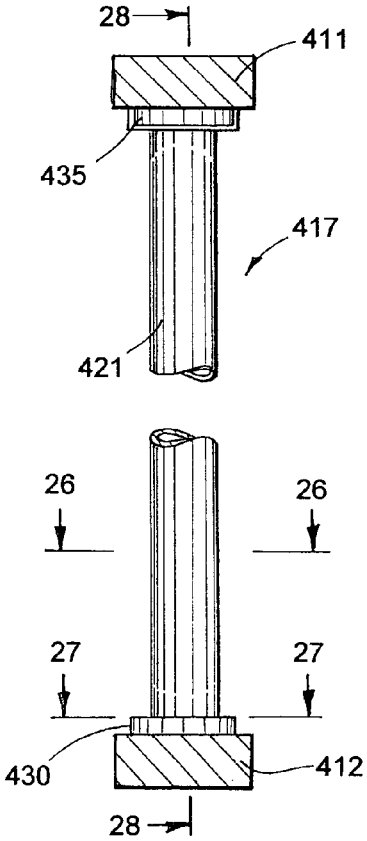
FIG. 25 is an enlarged foreshortened sectional view taken along line 25—25 of FIG. 24.
Figure 26:
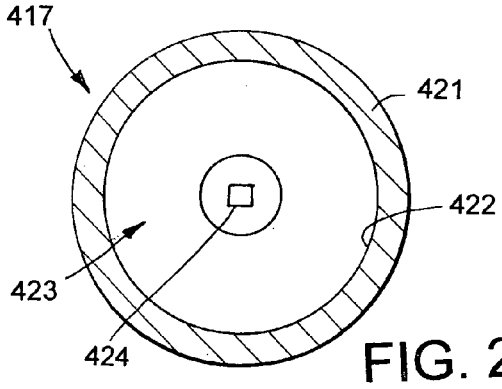
FIG. 26 is an enlarged sectional view taken along the line 26—26 of FIG. 25.
Figure 27:
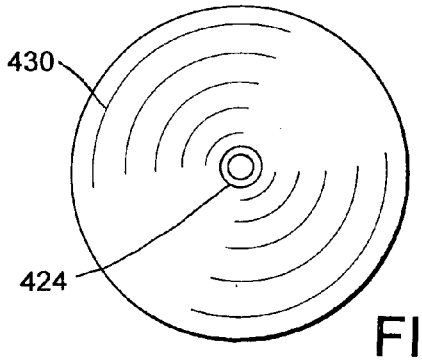
FIG. 27 is an enlarged sectional view taken along line 27—27 of FIG. 25.

A third modification of the spindle of a railing 331 is shown in FIGS. 17 to 23. The parts of railing 331 that corresponds to the parts of railing 10 have the same reference number with the prefix 3. Railing 331 has top and bottom rails 332 and 333 and upright spindles 317. Spindle 317 is a linear tube 321 having a cylindrical inside wall 322 telescoped over ball connectors or knobs 337 and 338. The opposite ends 324 and 325 of spindle 317 are located in flat surface engagement with plates 334 and 336. As shown in FIGS. 17, 19 and 21–23, the inside wall 322 of spindle 317 has a plurality of linear projections or ribs 326, 327, 328, and 329 projected inwardly and circumferentially spaced from each other. The projections 326–329 extended linearly the entire length of spindle 317. Each projection has a generally triangular cross section as shown in FIGS. 19, 22 and 23. The number of projections and the shape of the projections can vary. Spindle 317 is a metal tube extrusion, such as an aluminum extrusion, having a cylindrical outer wall 323, cylindrical inner wall 322 with projections 326–329. Spindle 312 can be a plastic member. In use, the opposite ends of spindle 317 are press fitted onto ball knobs 337 and 338. The projections 326–329, shown in FIG. 23, penetrate or cut into the side wall 335 of ball knob 338. The projections 326–329 extended into ball knobs 337 and 338 prevent spindle 317 from rotating relative to the ball knobs 337 and 338. Projections 326–329 reduce the need for close tolerances of the spindle 317 and ball knobs 337 and 338.

Figure 28:
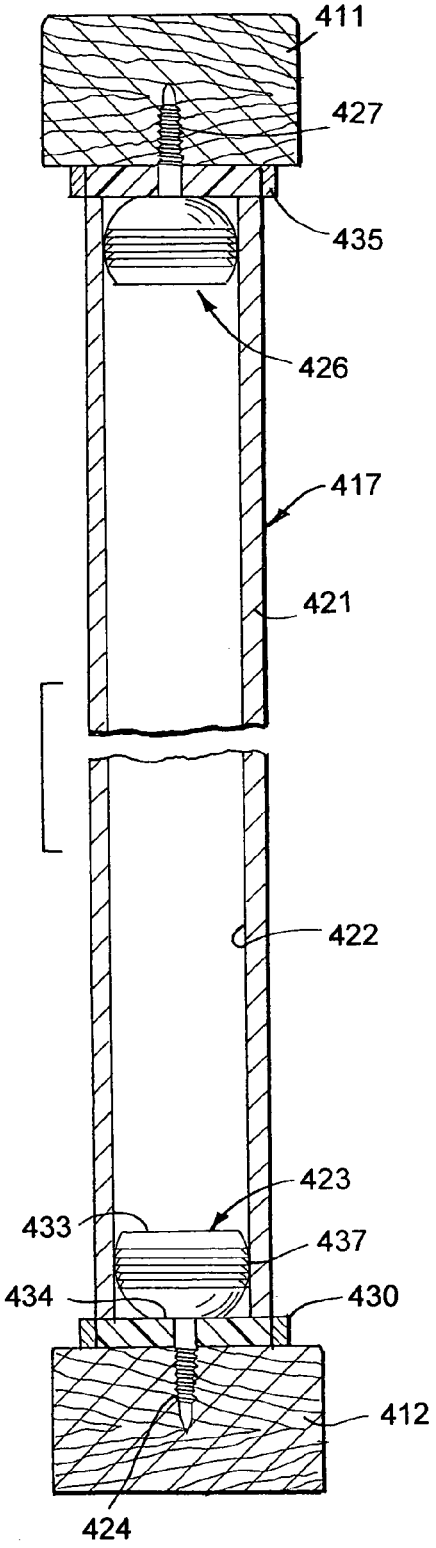
FIG. 28 is an enlarged foreshortened sectional view taken along line 28—28 of FIG. 25.
Figure 29:
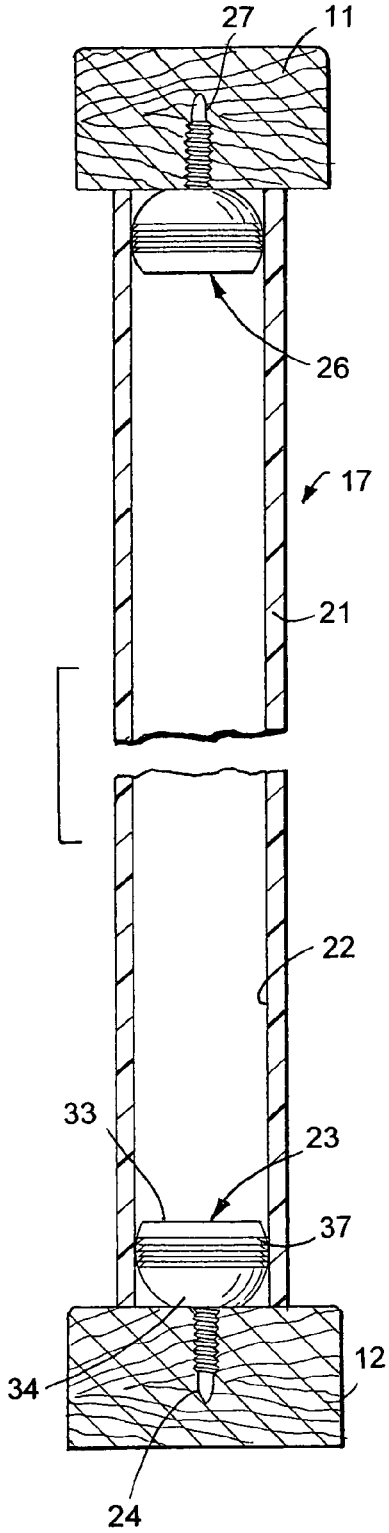
FIG. 29 is a sectional view similar to FIG. 28 of a further modification of the railing of FIG. 1.

A fourth modification of the railing 410, shown in FIGS. 24 to 28, has parts that correspond too railing 10 with the same reference numbers with the prefix 4. Railing 410 has horizontal top and bottom rails 411 and 412, such as copper treated wood rails, and laterally spaced upright spindles 417. As shown in FIG. 28, spindle 417 is a linear cylindrical tube 421, such as an aluminum tube, having an inside wall 422 telescoped with a tight or press fit around ball knobs 423 and 426. Opposite ends of spindle 417 are located in surface engagement with spacers 430 and 435. Spacers 430 and 435 are flat circular disks with central holes for deck screws 424 and 427. The disks are plastic members that separate the ends of spindle 421 from the wood rails 411 and 412 thereby inhibiting chemical corrosion of aluminum spindles. Disks may be coated metal washer-like members. Ball knobs 423 and 426 and desk screws 424 and 427 retain spacers 430 and 435 in surface engagement with the adjacent surfaces of rails 411 and 412. In use, opposite ends of the spindles 417 are press fitted around ball knobs 423 and 426 to secure spindles 417 to rails 411 and 412.

Ball knobs 23 and 29, shown in FIG. 29, are attached to wood rails 11 and 12 with fasteners 24 and 27. The bottom surface 34 of ball knob 23 engages rails 12 and is retained thereof with fastener 24, shown as a deck screw. The opposite ends of spindle 21, shown as a plastic tube, telescope over ball knobs 23 and 24 and contact rails 11 and 12 and anchor spindle 17 to rails 11 and 12.

While there has been shown and described preferred embodiments of the railings, spindles and ball knobs of the invention, it is understood that changes in the size, shapes and arrangement of the structures, rails, spindles and bar knobs may be made by persons skilled in the art without department from the invention.

What is claimed is:

1. A railing comprising: upright laterally spaced upright posts, a top rail extended between and connected to said posts, a bottom rail located below the top rail and extended between and connected to said posts, a plurality of laterally spaced upright spindles extended between said top and bottom rails, first ball knobs, first fasteners attaching the first ball knobs to the top rail, second ball knobs, second fasteners attaching the second ball knobs to the bottom rail in general vertical alignment with the first ball knobs, said spindles having opposite ends with inside walls located in telescopic relation with the first and second ball knobs thereby anchoring the spindles on the rails, first spacers comprising generally circular first disks located between the first ball knobs and the top rail spacing the first ball knobs and spindles from the top rail, said first fasteners retaining the first disks in engagement with the top rail and connecting the first ball knobs to the top rail, and second spacers comprising generally circular second disks located between the second ball knobs and the bottom rail spacing the second disks and spindles from the bottom rail, and second fasteners retaining the second disks in engagement with the bottom rail and connecting the second ball knobs to the bottom rail.

2. The railing of claim 1 wherein: said spindles are linear tubes having open opposite ends telescoped in tight fit engagement around the first and second ball knobs.

3. The railing of claim 2 wherein: said inside walls of the spindles have inwardly directed projections engageable with the first and second ball knobs to inhibit rotation of the spindles relative to the first and second knobs.

4. The railing of claim 1 wherein: each of said first and second ball knobs have a spherical body having an annular convex side wall located in a tight frictional contact with an inside wall of the spindle.

5. The railing of claim 4 wherein: said convex side wall includes a plurality of spaced circumferential outwardly extended continuous ribs located in bias contact with said inside wall of the spindle.

6. The railing of claim 1 wherein: each of said first and second ball knobs have outwardly extended annular ribs located in tight friction contact with an inside wall of one of the spindles.

7. The railing of claim 1 wherein: said inside walls of the spindles have inwardly directed projections, and said first and second knobs having outwardly directed annular ribs, said projections being engageable with said ribs to inhibit rotations of the spindles relative to the first and second knobs.

8. A railing comprising: a top rail, a bottom rail located below the top rail, a plurality of laterally spaced upright spindles extended between said top and bottom rails, first ball knobs, first fasteners attaching the first ball knobs to the top rail, second ball knobs, second fasteners attaching the second ball knobs to the bottom rail in general vertical alignment with the first ball knobs, said spindles having opposite ends with inside walls located in telescopic relation with the first and second ball knobs thereby anchoring the spindles on the rails, first spacers comprising generally circular first disks located in engagement with the top rail spacing the first ball knobs from the top rail, said first fasteners retaining the first disks in engagement with the top rail and connecting the first ball knobs to the top rail, second spacers comprising generally circular second disks located in engagement with the bottom rail, said second fasteners retaining the second disks in engagement with the bottom rail and connecting the second ball knobs to the bottom rail.

9. The railing of claim 8 wherein: said spindles are linear tubes having open opposite ends telescoped in tight fit engagement around the first and second ball knobs.

10. The railing of claim 8 wherein: said inside walls of said spindles have inwardly directed projections engageable with the first and second ball knobs to inhibit rotation of the spindles relative to the first and second knobs.

11. The railing of claim 8 wherein: each of said first and second ball knobs have a spherical body having an annular convex side wall located in a tight frictional contact with an inside wall of the spindle.

12. The railing of claim 11 wherein: said convex side wall includes a plurality of laterally spaced and outwardly extended continuous annular ribs located in bias contact with said inside wall of the spindle.

13. The railing of claim 8 wherein: each of said first and second ball knobs have outwardly extended annular ribs located in tight friction contact with an inside wall of the spindle.

14. The railing of claim 8 wherein: said inside walls of the spindles have inwardly directed projections, said first and second knobs having circumferential outwardly directed ribs, said projections being engageable with ribs to inhibit rotation of the spindles relative to the first and second knobs.

* * * * *